US007380593B2

(12) United States Patent
Lohbeck

(10) Patent No.: US 7,380,593 B2
(45) Date of Patent: Jun. 3, 2008

(54) EXPANDABLE TUBES WITH OVERLAPPING END PORTIONS

(75) Inventor: Wilhelmus Christianus Maria Lohbeck, Rijswijk (NL)

(73) Assignee: Shell Oil Company, Houston, TX (US)

( * ) Notice: Subject to any disclaimer, the term of this patent is extended or adjusted under 35 U.S.C. 154(b) by 281 days.

(21) Appl. No.: 10/496,889

(22) PCT Filed: Nov. 27, 2002

(86) PCT No.: PCT/EP02/13559

§ 371 (c)(1),
(2), (4) Date: Sep. 29, 2004

(87) PCT Pub. No.: WO03/046334

PCT Pub. Date: Jun. 5, 2003

(65) Prior Publication Data

US 2005/0039910 A1 Feb. 24, 2005

(30) Foreign Application Priority Data

Nov. 28, 2001 (EP) ..... 01309978

(51) Int. Cl.
*E21B 23/00* (2006.01)

(52) U.S. Cl. ..... 166/206; 166/207

(58) Field of Classification Search ..... 166/384, 166/207, 230, 206, 208
See application file for complete search history.

(56) References Cited

U.S. PATENT DOCUMENTS 1,494,128 A 5/1924 Primrose
1,982,400 A 11/1934 Riemenschneider et al. ..... 29/153.1
2,357,123 A 8/1944 Maxwell ..... 153/80.5
3,023,178 A 2/1962 Greenlee et al. ..... 260/22
3,067,801 A 12/1962 Sortor ..... 153/80
3,191,680 A 6/1965 Vincent ..... 166/46
3,713,276 A 1/1973 Owen et al. ..... 166/277
4,262,518 A 4/1981 Creger et al. ..... 72/393
5,366,012 A 11/1994 Lohbeck ..... 166/277
5,513,703 A 5/1996 Mills et al. ..... 166/55.1
5,613,557 A 3/1997 Blount et al. ..... 166/277
5,785,120 A 7/1998 Smalley et al. ..... 166/55

(Continued)

FOREIGN PATENT DOCUMENTS

EP 0952305 10/1999

(Continued)

OTHER PUBLICATIONS

TH2656 PCT/US2005/007547 International Search Report dated Oct. 6, 2005, authorized officer van Berlo, A.

(Continued)

*Primary Examiner*—Jennifer H. Gay
*Assistant Examiner*—Brad Harcourt

(57) ABSTRACT

An expandable tubular element for use in a wellbore formed in an earth formation, the tubular element having a first radially expandable tube and a second radially expandable tube. The tubes are arranged in a manner that an end portion of the second tube extends into an end portion of the first tube, wherein a selected one of the end portions has a reduced resistance to radial expansion per unit length compared to a remainder portion of the tube to which the selected end portion pertains.

17 Claims, 3 Drawing Sheets

U.S. PATENT DOCUMENTS

| | | | | |
|---|---|---|---|---|
| 6,012,523 | A | 1/2000 | Campbell et al. | 166/277 |
| 6,098,717 | A | 8/2000 | Bailey et al. | 166/382 |
| 6,354,373 | B1 | 3/2002 | Vercaemer et al. | 166/277 |
| 6,450,261 | B1 | 9/2002 | Baugh | 166/277 |
| 6,460,615 | B1 | 10/2002 | Heijnen | 166/55 |
| 6,497,289 | B1 | 12/2002 | Cook et al. | 166/380 |
| 6,557,640 | B1 | 5/2003 | Cook et al. | 166/380 |
| 6,568,472 | B1 | 5/2003 | Gano et al. | 166/207 |
| 6,622,789 | B1 | 9/2003 | Braddick | 166/277 |
| 6,688,397 | B2 | 2/2004 | McClurkin et al. | 166/380 |
| 6,691,777 | B2 | 2/2004 | Murray et al. | 166/216 |
| 6,719,064 | B2 * | 4/2004 | Price-Smith et al. | 166/387 |
| 6,722,427 | B2 | 4/2004 | Gano et al. | 166/217 |
| 6,799,637 | B2 * | 10/2004 | Scheky et al. | 166/384 |
| 2002/0033262 | A1 | 3/2002 | Musselwhite et al. | 166/285 |
| 2002/0104647 | A1 | 8/2002 | Lawrence | 166/55.1 |
| 2003/0075339 | A1 | 4/2003 | Gano et al. | 166/380 |
| 2003/0150608 | A1 | 8/2003 | Smith, Jr. et al. | 166/118 |
| 2003/0178204 | A1 | 9/2003 | Echols et al. | 166/386 |
| 2003/0192703 | A1 | 10/2003 | Williams et al. | 166/376 |
| 2004/0159446 | A1 | 8/2004 | Haugen et al | 166/384 |
| 2004/0168796 | A1 | 9/2004 | Baugh et al. | 166/207 |
| 2005/0000686 | A1 * | 1/2005 | Lohbeck | 166/207 |
| 2005/0045342 | A1 | 3/2005 | Luke et al. | 166/384 |
| 2005/0056433 | A1 | 3/2005 | Rings et al. | 166/384 |
| 2005/0056434 | A1 | 3/2005 | Watson et al. | 166/384 |

FOREIGN PATENT DOCUMENTS

| | | | |
|---|---|---|---|
| EP | 0952306 | | 10/1999 |
| EP | 1306519 | A2 | 5/2003 |
| GB | 2392686 | A | 3/2004 |
| GB | 2398312 | A3 | 8/2004 |
| GB | 2399848 | A | 9/2004 |
| GB | 2401131 | A | 11/2004 |
| RU | 2108448 | | 10/1998 |
| WO | WO9325800 | | 12/1993 |
| WO | 96/37680 | | 11/1996 |
| WO | 98/22690 | | 5/1998 |
| WO | 00/26502 | | 5/2000 |
| WO | 01/20125 | | 3/2001 |
| WO | WO0223007 | A1 | 3/2002 |
| WO | WO0229199 | A1 | 4/2002 |
| WO | WO02053867 | A3 | 7/2002 |
| WO | WO02086286 | A2 | 10/2002 |
| WO | WO03015954 | A1 | 2/2003 |
| WO | WO03016669 | A2 | 2/2003 |
| WO | WO03023178 | A2 | 3/2003 |
| WO | WO03066788 | A1 | 8/2003 |
| WO | WO02004007892 | A2 | 1/2004 |
| WO | WO02004079150 | A2 | 9/2004 |
| WO | WO2004079157 | A1 | 9/2004 |
| WO | WO02004081346 | A2 | 9/2004 |

OTHER PUBLICATIONS

TH2656 PCT/US2005/007547 Written Opinion of the International Searching Authority, dated Oct. 6, 2005 authorized officer, van Berlo, A.

* cited by examiner

EXPANDABLE TUBES WITH OVERLAPPING END PORTIONS

FIELD OF THE INVENTION

The present invention relates to an expandable tubular element for use in a wellbore formed in an earth formation, the tubular element comprising a first radially expandable tube and a second radially expandable tube, said tubes being arranged in a manner that an end portion of the second tube extends into an end portion of the first tube. The tubular element can be, for example, a casing which is installed in the wellbore to strengthen the borehole wall and to prevent collapse of the wellbore.

BACKGROUND OF THE INVENTION

In a conventional well several casing strings are run into the wellbore as drilling proceeds, whereby each subsequent casing must pass through the previous casing, and therefore must be of smaller diameter than the previous casing. A consequence of such scheme is that the available wellbore diameter through which tools or fluids can pass, becomes stepwise smaller.

It has been proposed to alleviate this problem by installing each subsequent casing in a manner that a relatively short upper end portion thereof extends into the previous casing, and thereafter radially expanding the subsequent casing to an inner diameter substantially equal to the inner diameter of the previous casing. Since the upper end portion of the subsequent casing extends into the lower end portion of the previous casing, the two overlapping portions must be expanded simultaneously. Consequently the expansion force/pressure required to expand these overlapping portions is significantly higher than for the remainder of the lower casing, therefore there is an increased risk that the expander becomes stuck in the overlapping portions of the casings. Also, in case of hydraulic expansion, there is a risk that the fluid pressure required to move the expander through the overlapping portions rises to an unacceptably high level causing the already expanded casing section to fail (e.g. connector failure or pipe burst).

Summary of the Invention

In accordance with the invention there is provided an expandable tubular element for use in a wellbore formed in an earth formation, the tubular element comprising a first radially expandable tube and a second radially expandable tube, said tubes being arranged in a manner that an end portion of the second tube extends into an end portion of the first tube, wherein a selected one of said end portions has a reduced resistance to radial expansion per unit length compared to a remainder portion of the tube to which the selected end portion pertains.

By virtue of the feature that the selected end portion has a reduced resistance to radial expansion, the total expansion force/pressure required to simultaneously expand the overlapping portions is reduced.

For most applications it will be preferred that the selected end portion is the end portion of the first tube, i.e. the end portion which extends around the end portion of the second tube.

The end portion having a reduced resistance to radial expansion can be integrally formed with the tube to which the end portion pertains. Alternatively, said end portion can be part of a muff which axially overlaps with a third tube forming part of the tubular element. In such application it is preferred that the entire muff has a reduced resistance to radial expansion. Suitably one of the first and second tubes extends into the muff at one side thereof, and the third tube extends into the muff at the other side thereof.

Preferably said end portion of reduced resistance to radial expansion includes at least one section of reduced resistance to stretching in circumferential direction compared to said remainder portion of the tube. Each section of reduced resistance to stretching can for example include a foldable member, which foldable member is arranged to deform between a folded state and an unfolded state upon radial expansion of the selected end portion. In a preferred embodiment the foldable member includes a folded wall section provided with at least one slit extending substantially parallel to an outer surface of the wall section so as to divide the wall section into a plurality of wall layers. Suitably each slit extends along the full circumference of the selected end portion, in which case the end portion preferably has the shape of a corrugated tube.

DESCRIPTION OF THE DRAWINGS

The invention will be described hereinafter in more detail and by way of example with reference to the accompanying drawings in which.

In the Figures like reference numerals relate to like components.

DETAILED DESCRIPTION OF THE INVENTION

Figure 1:
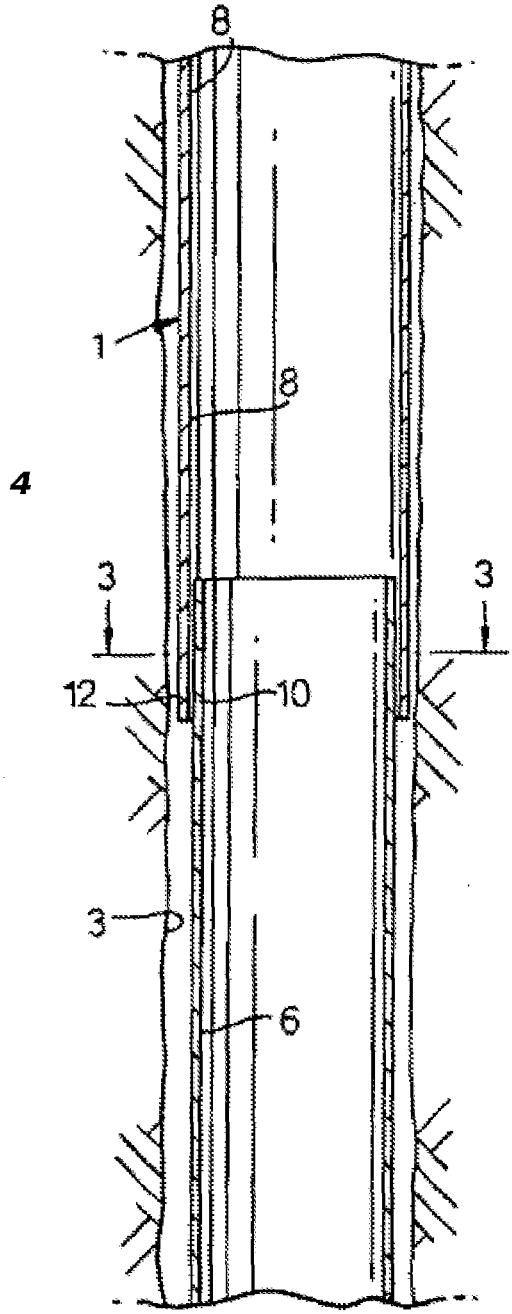
FIG. 1 schematically shows an embodiment, in longitudinal section, of the expandable tubular element of the invention before the expansion process.

Referring to FIG. 1 there is shown an expandable tubular element 1 extending into a wellbore 3 formed in an earth formation 4. The tubular element includes a first tube 8 which already has been radially expanded, and a second tube 6 which is to be radially expanded. An end portion 10 of the second tube 6 extends into an end portion 12 of the first tube 8. The second tube 6 has an outer diameter slightly smaller than the inner diameter of the (expanded) first tube 8.

Figure 2:
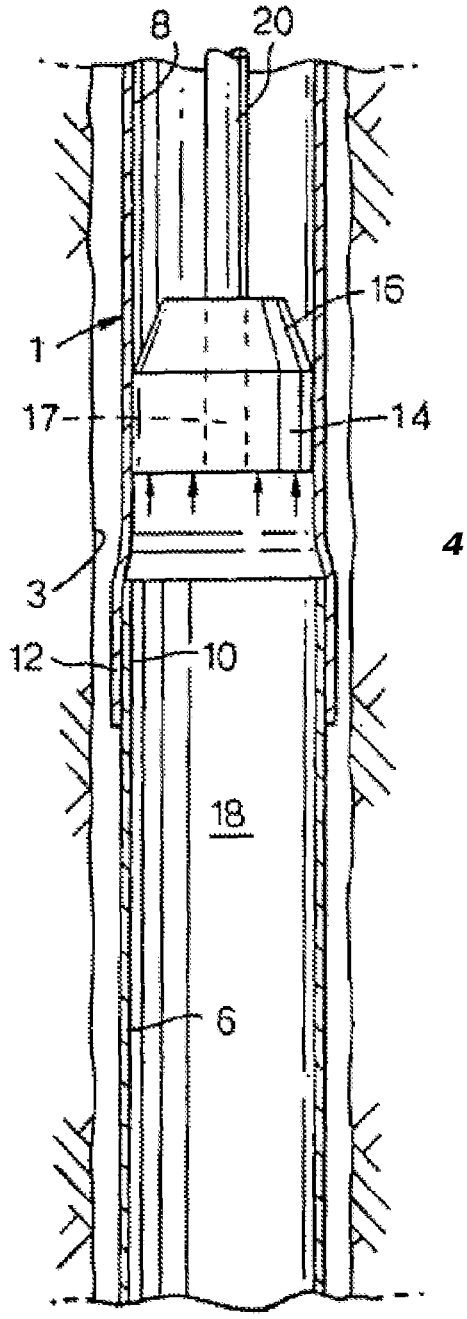
FIG. 2 schematically shows the embodiment of FIG. 1 after the expansion process.

In FIG. 2 is shown the tubular element 1 during the expansion process whereby the second tube 6 is expanded to an inner diameter substantially equal to the inner diameter of the already expanded first tube 8. To achieve expansion of the second tube 6, an expander 14 having a tapered front end part 16 is moved in longitudinal direction through the tubular element 1. The expander 14 has a longitudinal through passage 17 which provides fluid communication between the space 18 in the tubular element 1 below the expander 14 and a hollow string 20 connected to a fluid pump (not shown) at surface.

Figure 3:
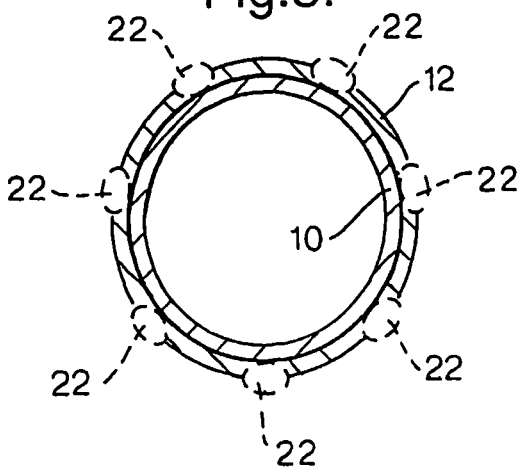
FIG. 3 schematically shows cross-section 3-3 of FIG. 1.

In FIG. 3 is shown a cross-section of the tubular element 1 at the level of the overlapping end portions 10, 12 of the tubes 6, 8. The end portion 12 of tube 8 is provided with a plurality of sections 22 of reduced resistance to stretching in circumferential direction compared to the remainder portion of the tube 8.

Figure 4A:
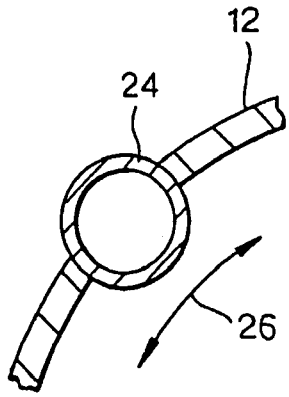
FIG. 4A schematically shows a first embodiment of a detail of FIG. 3 before radial expansion thereof.
Figure 4B:
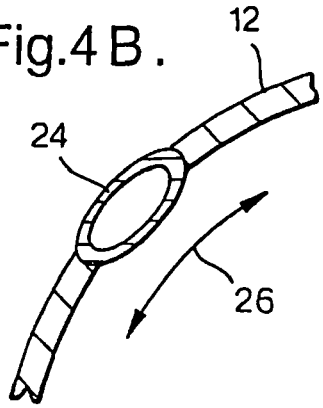
FIG. 4B schematically shows the first embodiment of the detail after radial expansion thereof.

In FIGS. 4A, 4B is shown a first embodiment of section 22 including a tubule 24 extending substantially in longitudinal direction of the expandable tubular element 1. The tubule 24 is arranged to deform upon stretching in circumferential direction 26 of end portion 12 due to radial expansion thereof, from a relatively round shape (FIG. 4A) to a relatively flat shape (FIG. 4B).

Figure 5A:
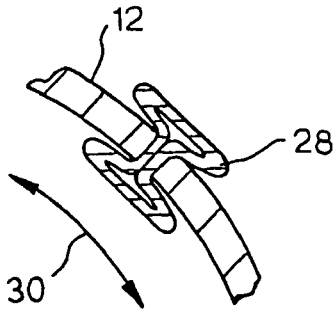
FIG. 5A schematically shows a second embodiment of the detail of FIG. 3 before radial expansion thereof.
Figure 5B:
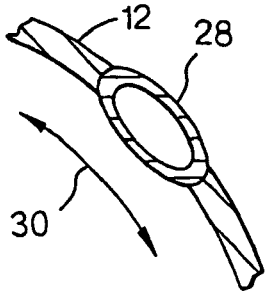
FIG. 5B schematically shows the second embodiment of the detail after radial expansion thereof.

In FIGS. 5A, 5B is shown a second embodiment of section 22 including a tubule 28 extending substantially in longitudinal direction of the expandable tubular element 1. Tubule 28 has been compressed in circumferential direction 30, and is arranged to deform from the compressed configuration (FIG. 5A) to a less compressed configuration (FIG. 5B) upon stretching in circumferential direction 30 due to radial expansion of the end portion 12.

Figure 6A:
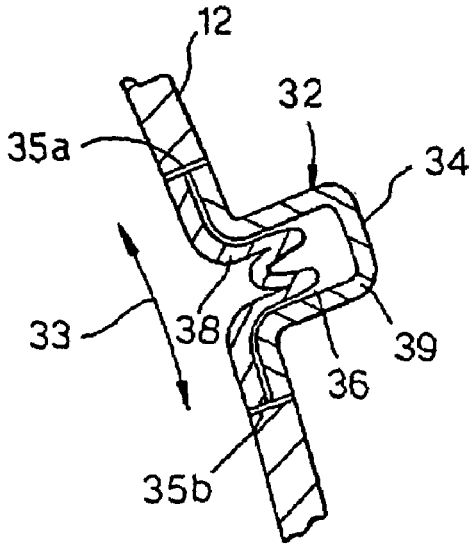
FIG. 6A schematically shows a third embodiment of the detail of FIG. 3 before radial expansion thereof.
Figure 6B:
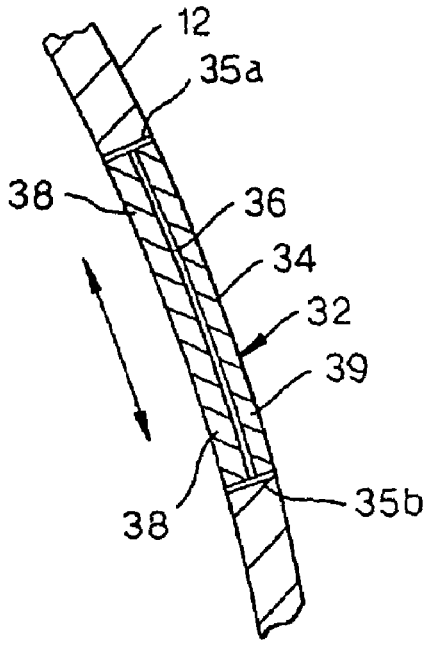
FIG. 6B schematically shows the third embodiment of the detail after radial expansion thereof.

In FIGS. 6A, 6B is shown a third embodiment of section 22 including a foldable member 32 arranged to deform between a folded state (FIG. 6A) and an unfolded state (FIG. 6B) upon stretching in circumferential direction 33 due to radial expansion of end portion 12. The foldable member 32 includes a folded wall section 34 provided with at least one slit 36 extending substantially parallel to an outer surface of the wall section 34 so as to divide the wall section 34 into a plurality of wall layers 38, 39. The foldable member 32 is welded to the wall portion 12 at welds 35a, 35b.

Figure 7A:
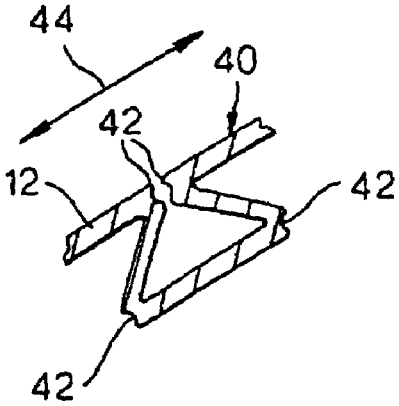
FIG. 7A schematically shows a fourth embodiment of the detail of FIG. 3 before radial expansion thereof.
Figure 7B:
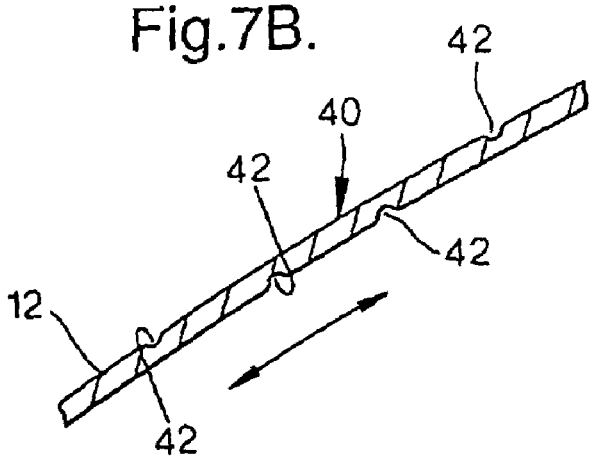
FIG. 7B schematically shows the fourth embodiment of the detail after radial expansion thereof.

In FIGS. 7A, 7B is shown a fourth embodiment of section 22 including a hinged wall section 40 provided with plastic hinges 42. The hinged wall section 40 has been folded radially inward at the hinges 42 before radial expansion of end portion 12 (FIG. 7A). After radial expansion by stretching in circumferential direction 44 of end portion 12 the wall section 40 has a more circular shape than before (FIG. 7B).

During normal operation the first tube 8 is installed in the wellbore 3, radially expanded and fixed in any suitable manner, for example by providing a layer of cement around the tube 8. Subsequently the second tube 6 is lowered through the first tube 8 until the second tube 6 takes the position shown in FIG. 1. During lowering of tube 6, the expander 14 is positioned in a lower end portion (not shown) of tube 6 which has an increased internal diameter in order to accommodate the expander 14. Alternatively the expander 14 can be positioned initially below the lower end of tube 6 and thereafter be pulled into the tube 6. After lowering the second tube 6, the hollow string 20 (which can be for example a drill string) is connected to the upper end of the expander 14 and the bottom of the second tube is sealed, for example by means of a suitable plug (not shown). Alternatively the string 20 has been connected to the expander 14 prior to lowering of tube 6, whereby the assembly of tube 6 and expander 14 can be lowered on string 20.

In a next step the fluid pump is operated to pump fluid into the space 18 of the tubular element 1 so as to induce the expander 14 to move upwardly through the second tube 6 thereby radially expanding the second tube 6. As the expander 14 moves through the overlapping end portions 10, 12, both end portions 10, 12 are radially expanded whereby the sections 22 of end portion 12 are stretched in circumferential direction. By virtue of the reduced resistance to stretching of the sections 22, the radial force necessary to expand end portion 12 is significantly reduced compared to the radial force required to expand the remainder of tube 6. Thus it is achieved that the total force/pressure required to simultaneously expand the end portions 10, 12 is substantially equal to (or only slightly larger than) the force needed to expand the remainder of tube 6. Thereby the risk of the expander 14 becoming stuck in the tubular element 1 at the level of the overlapping portions 10, 12 has been greatly reduced. Moreover, the safety margin of burst pressure minus expansion pressure is hardly compromised.

Stretching in circumferential direction of the various embodiments of sections 22 is discussed hereinafter in more detail.

The tubule 24 shown in FIGS. 4A, 4B deforms from a substantially circular cross-section to a substantially elliptical or flat cross-section due to local bending of the tubule.

The tubule 28 shown in FIGS. 5A, 5B deforms from the compressed configuration to a less compressed configuration (FIG. 5B) upon stretching in circumferential direction 30 due to radial expansion of the end portion 12.

The foldable member 32 shown in FIGS. 6A, 6B deforms between a folded state (FIG. 6A) and an unfolded state (FIG. 6B) upon stretching in circumferential direction 33 due to radial expansion of end portion 12. During such deformation the wall layers 38, 39 are allowed to slide along each other at their common interface formed by slit 36. By virtue of such sliding movement the force required to unfold the member 32 is significantly less than the force required to unfold a section of tube having a thickness of twice the thickness of the individual wall layers, but without slit.

The hinged wall section 40 shown in FIGS. 7A, 7B deforms by virtue of bending of the wall of tube portion 12 at plastic hinges 42. Thereby the position of wall section 40 wherein the wall section 40 is bent radially inward at the hinges 42, changes into a position wherein the wall section 40 assumes a more circular cross-sectional shape.

Optionally the tubules described hereinbefore are filled with a fluidic seal compound, and the tubules are provided with small openings (not shown) arranged so as to allow flow of the seal compound in-between the end portions of the respective tubes in order to form a seal between said end portions. Also, the seal compound could be released from the tubules by virtue of local shearing/cracking of the tubules due to the radial expansion process. In the latter case no openings for release of the fluid would have to be provided in the tubules.

In an alternative arrangement of the tubules, the selected end portion is formed of a plurality of tubules arranged adjacent each other and mutually interconnected.

In such arrangement no separate sections of tube are needed to interconnect the tubules.

Instead of expanding the overlapping end portions of the tubes simultaneously, the end portion having reduced resistance to circumferential stretching can be expanded first i.e. before the other end portion overlaps therewith. This can be achieved, for example, by applying a sufficiently high fluid pressure to the inner surface of the end portion having reduced resistance to circumferential stretching. Such method allows the application of an expandable expander which is positioned in its unexpanded state in the radially unexpanded end portion of reduced resistance to circumferential stretching, and then expanded to its expanded state. Thereafter the expander is pulled or pushed through the remainder of the tube to which the end portion having reduced resistance to circumferential stretching pertains.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. An expandable tubular element for use in a wellbore formed in an earth formation, the tubular element comprising a first radially expandable tube having a first inside diameter and a second radially expandable tube having an initial second inside diameter that is smaller than said first inside diameter, said tubes being arranged in a manner that an end portion of the second tube extends into an end portion of the first tube so as to form an overlapping portion, wherein a selected one of said end portions has a reduced resistance to radial expansion per unit length compared to a remainder portion of the tube to which the selected end portion pertains, said end portion of reduced resistance to radial expansion including at least one section of reduced resistance to stretching in circumferential direction compared to said remainder portion of the tube, wherein said at least one section of reduced resistance to stretching includes a foldable member, the foldable member being arranged to deform between a folded state and an unfolded state upon radial expansion of the selected end portion; wherein said second tube is expanded to have an expanded inside diameter that is apporximately the same as the first inside diameter, and wherein the end portion of the first tube is expanded to have an expanded inside diameter that is greater than the first inside diameter.

2. The expandable tubular element of claim 1, wherein said end portion of reduced resistance to radial expansion is the end portion of the first tube.

3. The expandable tubular element of claim 2, wherein said at least one section of reduced resistance to stretching includes a tubule extending substantially in longitudinal direction of the expandable tubular element, the tubule being arranged to deform upon radial expansion of the selected end portion.

4. The expandable tubular element of claim 3, wherein said selected end portion includes a plurality of said tubules spaced along the circumference of the selected end portion.

5. The expandable tubular member of claim 1, wherein the foldable member includes a folded wall section provided with at least one slit extending substantially parallel to an outer surface of the wall section so as to divide the wall section into a plurality of wall layers.

6. The expandable tubular element of claim 5, wherein the foldable member includes a wall section provided with at least one hinge.

7. The expandable tubular element of claim 1, wherein the foldable member includes a wall section provided with at least one hinge.

8. The expandable tubular element of claim 7, wherein each hinge is a plastic hinge.

9. The expandable tubular element of claim 1, wherein said end portion of reduced resistance to radial expansion is part of a muff which axially overlaps with a third tube forming part of the tubular element.

10. The expandable tubular element of claim 9, wherein one of the first and second tubes extends into the muff at one side thereof, and the third tube extends into the muff at the other side thereof.

11. An expandable tubular element for use in a wellbore formed in an earth formation, the tubular element comprising:

a first radially expandable tube and a second radially expandable tube, said tubes being arranged in a manner that an end portion of the second tube extends into an end portion of the first tube, wherein a selected one of said end portions has a reduced resistance to radial expansion per unit length compared to a remainder portion of the tube to which the selected end portion pertains, said end portion of reduced resistance to radial expansion including at least one section of reduced resistance to stretching in circumferential direction compared to said remainder portion of the tube;

wherein said at least one section of reduced resistance to stretching includes a foldable member, the foldable member being arranged to deform between a folded state and an unfolded state upon radial expansion of the selected end portion;

wherein said at least one section of reduced resistance to radial expansion includes a tubule extending substantially in longitudinal direction of the expandable tubular element, the tubule being arranged to deform upon radial expansion of the selected end portion; and wherein the tubule has a reduced resistance to radial expansion and contains a fluidic seal compound, and wherein the tubule is provided with small openings arranged to allow flow of the seal compound in-between said end portions so as to form a seal between the end portions.

12. The expandable tubular element of claim 11, wherein the tubule is arranged to deform from a relatively round shape to a relatively flat shape upon radial expansion of the selected end portion.

13. The expandable tubular element of claim 12, wherein said selected end portion includes a plurality of said tubules spaced along the circumference of the selected end portion.

14. The expandable tubular element of claim 11, wherein the tubule is compressed in circumferential direction of said selected end portion, and wherein the tubule is arranged to deform from the compressed configuration to a less compressed configuration upon radial expansion of the selected end portion.

15. The expandable tubular element of claim 14, wherein said selected end portion includes a plurality of said tubules spaced along the circumference of the selected end portion.

16. The expandable tubular element of claim 11, wherein said selected end portion includes a plurality of said tubules spaced along the circumference of the selected end portion.

17. An expandable tubular element for use in a wellborne formed in an earth formation, the tubular element comprising:

a first radially expandable tube and a second radially expandable tube, said tubes being arranged in a manner that an end portion of the second tube extends into an end portion of the first tube, wherein a selected one of said end portions has a reduced resistance to radial expansion per unit length compared to a remainder portion of the tube to which the selected end portion pertains, said end portion of reduced resistance to radial expansion including at least one section of reduced resistance to stretching in circumferential direction compared to said remainder portion of the tube, wherein said at least one section of reduced resistance to stretching includes a foldable member, the foldable member being arranged to deform between a folded state and an unfolded state upon radial expansion of the selected end portion;

wherein the foldable member includes a folded wall section provided with at least one slit extending substantially parallel to an outer surface of the wall section so as to divide the wall section into a plurality of wall layers; and wherein said at least one slit extends along the full circumference of the selected end portion.

* * * * *